US011350808B2

(12) United States Patent
Ko et al.

(10) Patent No.: US 11,350,808 B2
(45) Date of Patent: Jun. 7, 2022

(54) VACUUM CLEANER

(71) Applicant: LG ELECTRONICS INC., Seoul (KR)

(72) Inventors: Kyoungsuk Ko, Seoul (KR); Sungsuk Kang, Seoul (KR); Byungjin Kim, Seoul (KR); Sunghyuk Park, Seoul (KR); Koh Choi, Seoul (KR); Subong Hong, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 252 days.

(21) Appl. No.: 16/612,904

(22) PCT Filed: Apr. 18, 2018

(86) PCT No.: PCT/KR2018/004500
§ 371 (c)(1),
(2) Date: Nov. 12, 2019

(87) PCT Pub. No.: WO2018/230830
PCT Pub. Date: Dec. 20, 2018

(65) Prior Publication Data

US 2020/0163516 A1 May 28, 2020

(30) Foreign Application Priority Data

Jun. 14, 2017 (KR) ..... 10-2017-0075120

(51) Int. Cl.
*A47L 9/28* (2006.01)
*A47L 9/32* (2006.01)
(Continued)

(52) U.S. Cl.
CPC ..... *A47L 9/2852* (2013.01); *A47L 9/248* (2013.01); *A47L 9/2805* (2013.01); *A47L 9/327* (2013.01); *A47L 5/362* (2013.01)

(58) Field of Classification Search
CPC ..... A47L 5/362; A47L 9/248; A47L 9/2805; A47L 9/2852; A47L 9/327
See application file for complete search history.

(56) References Cited

U.S. PATENT DOCUMENTS 8,079,113 B2 * 12/2011 Chong ..... A47L 5/36 15/319
2010/0132149 A1 * 6/2010 Jeong ..... A47L 9/2805 15/319
(Continued)

FOREIGN PATENT DOCUMENTS

CN 101554303 10/2009
CN 101554306 10/2009
(Continued)

OTHER PUBLICATIONS

International Search Report dated Aug. 20, 2018 issued in Application No. PCT/KR2018/004500.
(Continued)

*Primary Examiner* — Marc Carlson
(74) *Attorney, Agent, or Firm* — KED & Associates LLP

(57) ABSTRACT

The vacuum cleaner includes a cleaner body including a wheel for moving and a wheel motor for driving the wheel, a suction hose connected to the cleaner body, a handle connected to the suction hose, at least one detection sensor disposed in the suction hose to detect an inclination of the suction hose, and a controller controlling the wheel motor on the basis of the inclination of the suction hose detected by the at least one detection sensor.

13 Claims, 5 Drawing Sheets

(51) Int. Cl.
*A47L 9/24* (2006.01)
*A47L 5/36* (2006.01)

(56) References Cited

U.S. PATENT DOCUMENTS

| | | | | |
|---|---|---|---|---|
| 2013/0212829 | A1 | 8/2013 | Yoon et al. | |
| 2017/0071430 | A1* | 3/2017 | Ha | A47L 5/36 |
| 2020/0163516 | A1* | 5/2020 | Ko | A47L 9/2805 |

FOREIGN PATENT DOCUMENTS

| | | | | |
|---|---|---|---|---|
| CN | 103181742 | | 7/2013 | |
| CN | 204618094 | | 9/2015 | |
| CN | 105877607 | | 8/2016 | |
| CN | 105030147 | | 6/2017 | |
| EP | 2 898 808 | | 7/2015 | |
| JP | 02-172433 | | 7/1990 | |
| JP | 11-313789 | | 11/1999 | |
| JP | 2000-271052 | | 10/2000 | |
| JP | 2006-223429 | | 8/2006 | |
| JP | 2006-314569 | | 11/2006 | |
| JP | 2006-326186 | | 12/2006 | |
| JP | 2011-115228 | | 6/2011 | |
| KR | 10-0901032 | | 6/2009 | |
| KR | 10-2010-0081251 | | 7/2010 | |
| KR | 10-2013-0020071 | | 2/2013 | |
| KR | 10-2015-0033006 | | 4/2015 | |
| WO | WO-2008136575 | A1 * | 11/2008 | A47L 5/362 |
| WO | WO 2016/144064 | | 9/2016 | |

OTHER PUBLICATIONS

Australian Examination Report dated Jul. 18, 2020 issued in Application No. 2018283473.
Japanese Office Action dated Dec. 23, 2020.
European Search Report dated Feb. 23, 2021 issued in Application No. 18818396.6.
Chinese Office Action dated Mar. 19, 2021 issued in Application No. 201880037628.5.
Taiwanese Office Action dated Sep. 29, 2020 issued in Application No. 10920942160.
Chinese Office Action dated Oct. 12, 2020 issued in Application No. 201880037628.5.

* cited by examiner

[Fig. 1]
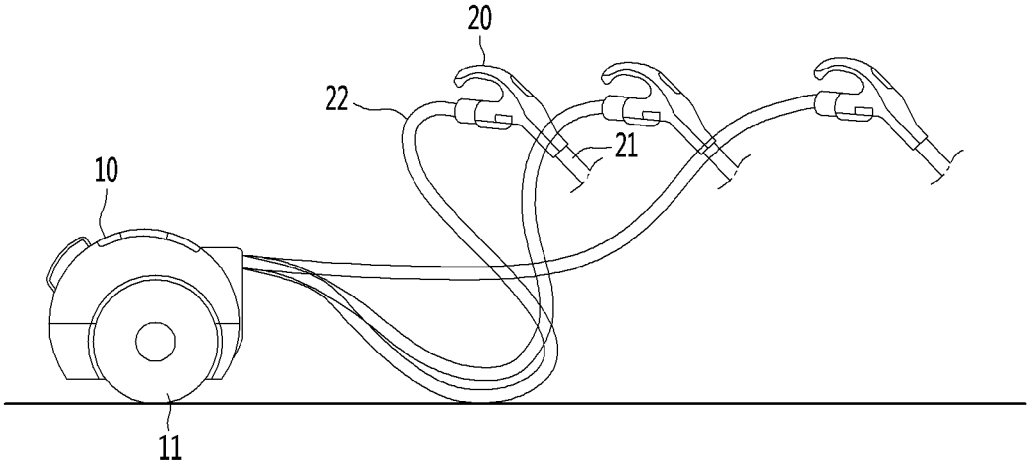
[Fig. 2]
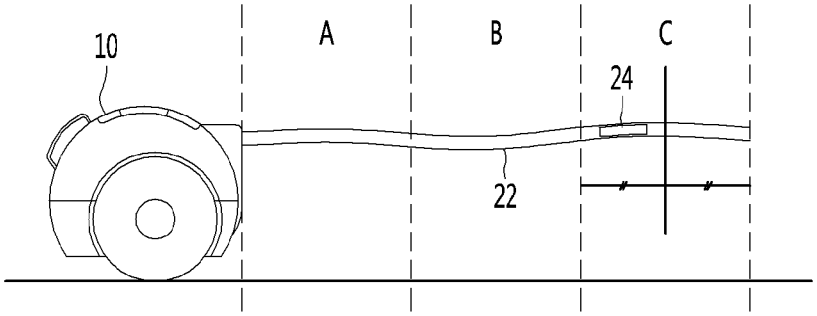
[Fig. 3]
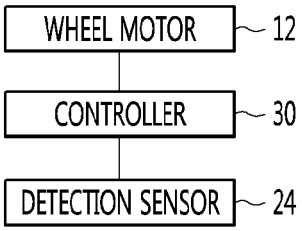
[Fig. 4]
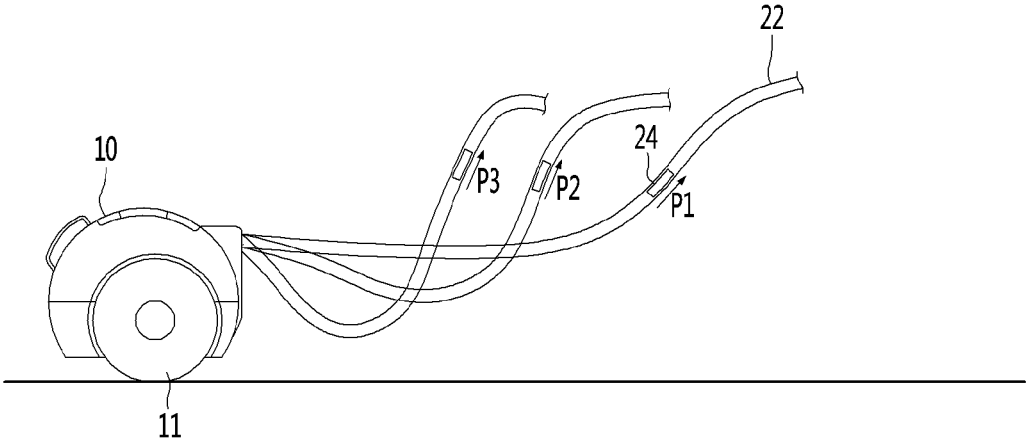

[Fig. 5]
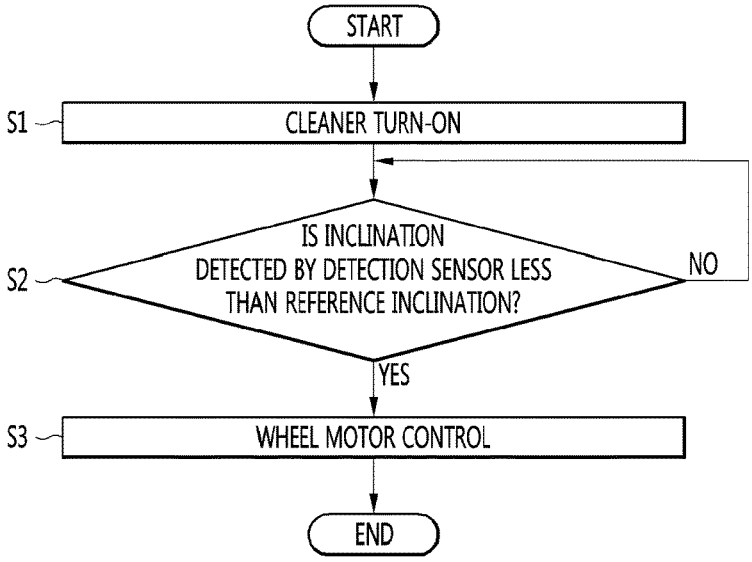
[Fig. 6]
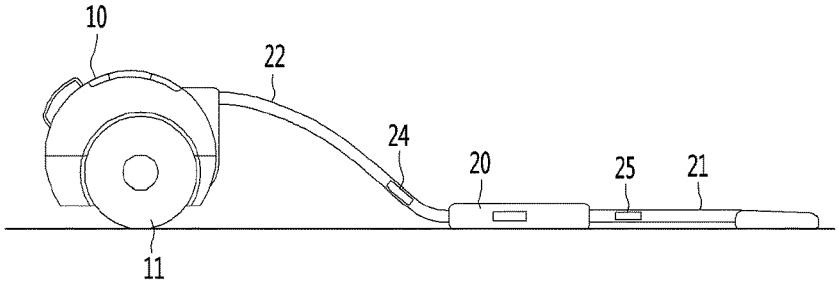
[Fig. 7]
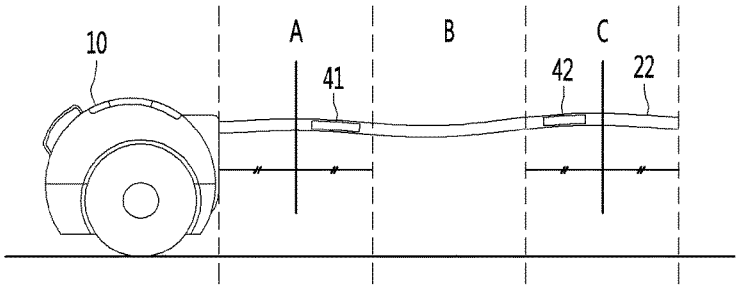
[Fig. 8]
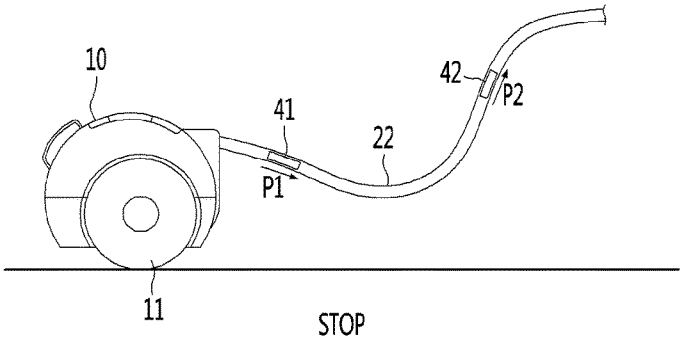

[Fig. 9]
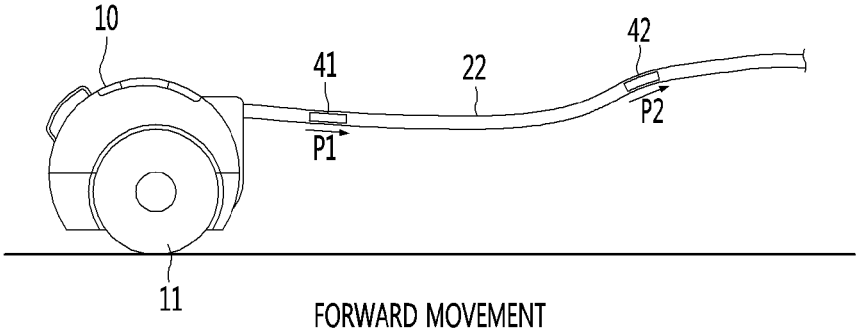
[Fig. 10]
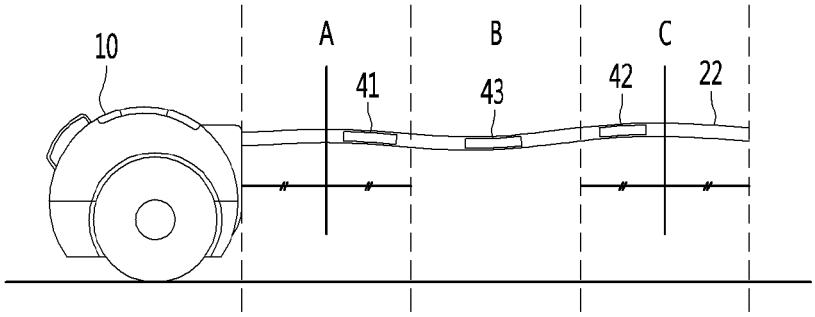
[Fig. 11]
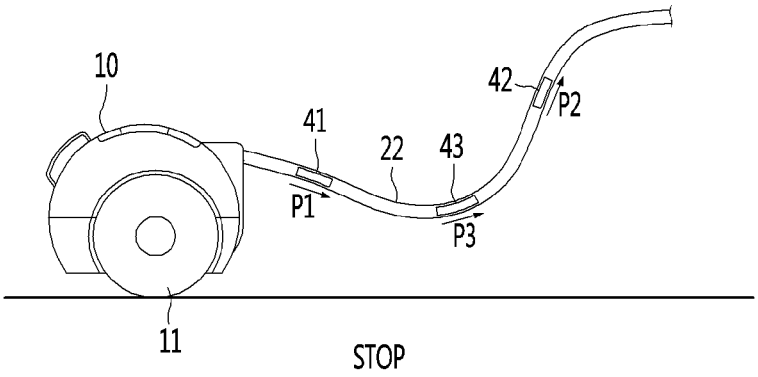
[Fig. 12]
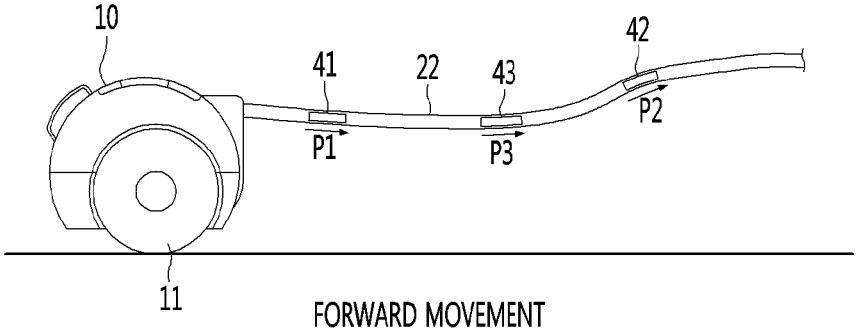

[Fig. 13]
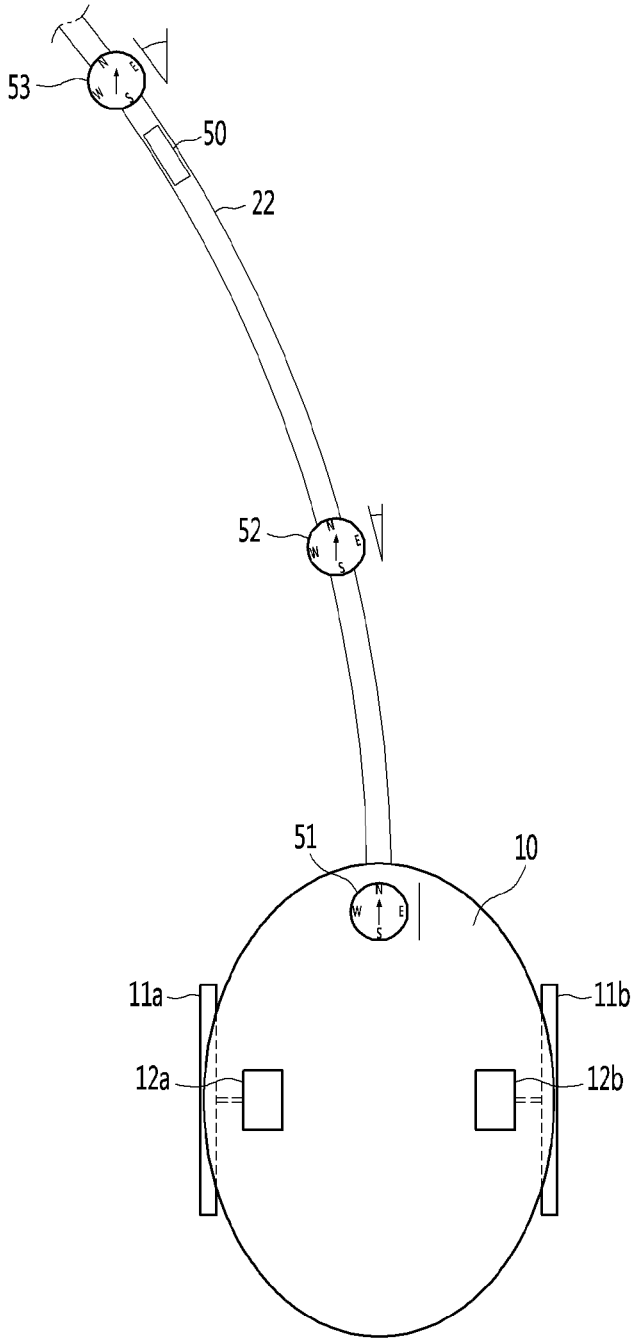

[Fig. 14]
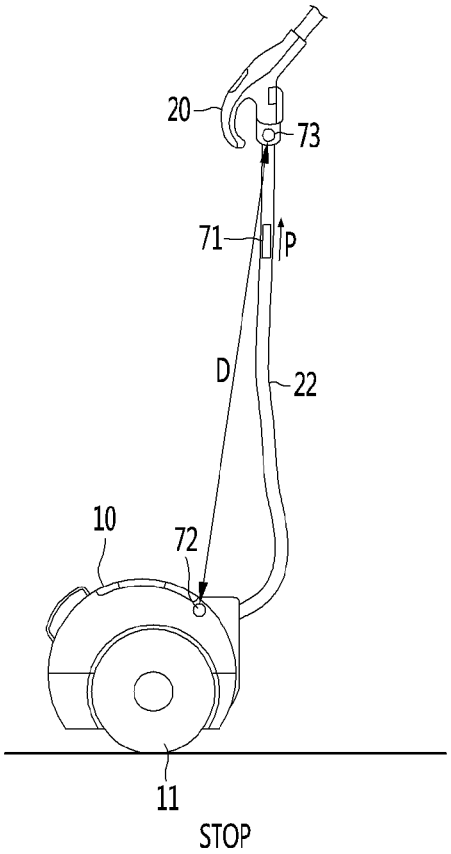
[Fig. 15]
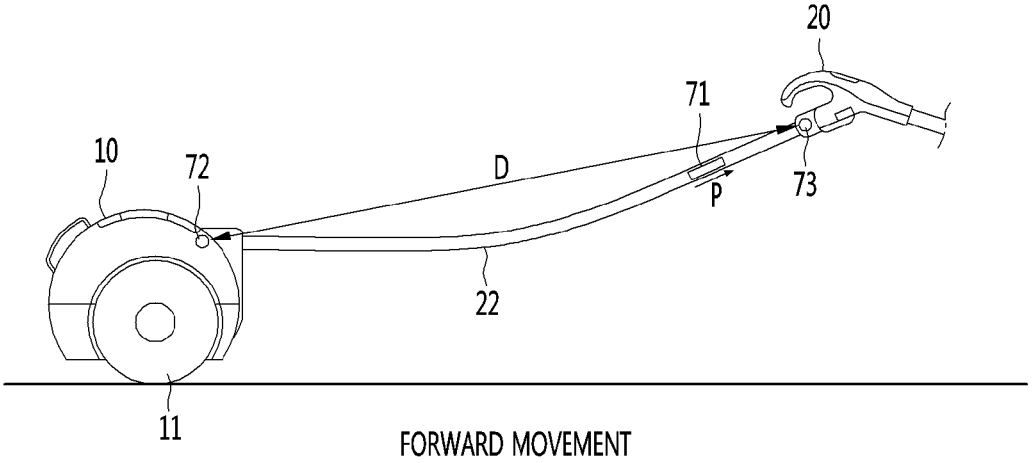

VACUUM CLEANER

CROSS-REFERENCE TO RELATED PATENT APPLICATIONS

This application is a U.S. National Stage Application under 35 U.S.C. § 371 of PCT Application No. PCT/KR2018/004500, filed Apr. 18, 2018, which claims priority to Korean Patent Application No. 10-2017-0075120, filed Jun. 14, 2017, whose entire disclosures are hereby incorporated by reference.

TECHNICAL FIELD

The present disclosure relates to a vacuum cleaner.

BACKGROUND ART

In general, vacuum cleaners are devices that suction dusts or foreign substances scattered on a surface to be cleaned by using a suction motor mounted in a main body to filter the dusts or foreign substances in the main body.

Such a vacuum cleaner may be largely classified into an up-right type vacuum cleaner in which a suction nozzle that is a suction hole is integrated with a main body and a canister type vacuum cleaner in which a suction nozzle communicates with a main body through a connection tube.

A vacuum cleaner is disclosed in Korean Patent Registration No. 10-1684072 that is a prior art document.

The vacuum cleaner disclosed in the prior art document includes a cleaner body including a moving unit, a suction device for suctioning air, a detection device for detecting movement of the suction device, and a controller controlling the moving unit on the basis of information detected by the detection device when the cleaner body needs to move.

The detection device includes an ultrasonic wave transmitting unit provided in a handle and an ultrasonic wave receiving unit provided in the cleaner body.

However, according to the prior art document, since the ultrasonic wave transmitting unit is provided in the handle, ultrasonic waves transmitted from the ultrasonic wave may be distorted by or interfere with a user when the user is positioned between the handle and the main body, and thus, the ultrasonic waves may not reach the ultrasonic wave receiving unit. As a result, although the handle is away from the cleaner body, the cleaner body does not move to the handle.

DISCLOSURE OF INVENTION

Technical Problem

The present disclosure provides a vacuum cleaner in which a sensing error of a sensor is reduced to allow the cleaner body to accurately follow a handle.

The present disclosure provides a vacuum cleaner in which a cleaner body follows a handle while using an inexpensive sensor.

The present disclosure provides a vacuum cleaner in which a cleaner body is prevented from moving to a handle in a state in which the handle is placed on the floor.

The present disclosure provides a vacuum cleaner in which a cleaner body is changeable in direction by detecting a moving direction of a handle.

Solution to Problem

A vacuum cleaner includes: a cleaner body including a wheel for moving and a wheel motor for driving the wheel; a suction hose connected to the cleaner body; a handle connected to the suction hose; at least one detection sensor disposed at the suction hose to detect an inclination of the suction hose; and a controller controlling the wheel motor on a basis of the inclination of the suction hose detected by the at least one detection sensor.

Advantageous Effects of Invention

According to the present disclosure, a sensing error of the sensor is reduced to allow the cleaner body to accurately follow a handle.

The cleaner body can follow the handle while using an inexpensive sensor.

The cleaner body is prevented from moving to the handle in a state in which the handle is placed on the floor since the cleaner can detect a state of the handle seated on the floor.

The cleaner body is changeable in direction by detecting the moving direction of the handle and can follow the cleaner body accurately.

BRIEF DESCRIPTION OF DRAWINGS

FIG. 1 is a perspective view of a vacuum cleaner according to a first embodiment.

FIG. 2 is a view illustrating a state in which a detection sensor is installed in a suction hose of the vacuum cleaner of FIG. 1.

FIG. 3 is a block diagram of the vacuum cleaner of FIG. 1.

FIG. 4 is a view illustrating a state in which the detection sensor is changed in position during a cleaning operation of the vacuum cleaner.

FIG. 5 is a flowchart for explaining a method of controlling the vacuum cleaner of FIG. 1.

FIG. 6 is a perspective view of a vacuum cleaner according to a second embodiment.

FIG. 7 is a view of a vacuum cleaner according to a third embodiment.

FIGS. 8 and 9 are views illustrating an operation of the vacuum cleaner depending on an inclination of a suction hose of the vacuum cleaner of FIG. 7.

FIG. 10 is a view of a vacuum cleaner according to a fourth embodiment.

FIGS. 11 and 12 are views illustrating an operation of the vacuum cleaner depending on an inclination of a suction hose of the vacuum cleaner of FIG. 10.

FIG. 13 is a view of a vacuum cleaner according to a fifth embodiment.

FIGS. 14 and 15 are views of a vacuum cleaner according to a sixth embodiment.

MODE FOR THE INVENTION

FIG. 1 is a perspective view of a vacuum cleaner according to a first embodiment.

FIG. 2 is a view illustrating a state in which a detection sensor is installed in a suction hose of the vacuum cleaner of FIG. 1, and FIG. 3 is a block diagram of the vacuum cleaner of FIG. 1.

Referring to FIGS. 1 to 3, a vacuum cleaner according to a first embodiment may include a cleaner body 10 including a suction motor, a suction hose 22 connected to the cleaner body 10, a handle 20 connected to the suction hose 22, and an extension tube 21 connected to the handle 20. The extension tube 21 may be connected to a nozzle (not shown) for suctioning air on the floor.

A hose made of a flexible material that is deformable in shape may be used as the suction hose 22.

The cleaner body 10 may include a plurality of wheels 11 for moving of the cleaner body 10, a plurality of wheel motors 12 for respectively rotating the plurality of wheels 11, a detection sensor 24 installed in the suction hose 22, and a controller 30 controlling the plurality of wheel motors 12 on the basis of information detected by the detection sensor 24.

The detection sensor 24 may be, for example, an acceleration sensor, a 6-axis sensor, or a 9-axis sensor. In any type of sensor, the detection sensor 24 may detect an inclination (or an inclination of the suction hose with respect to the gravity direction) of the suction hose 22 with respect to the floor.

The detection sensor 24 may communicate with the controller 30 in a wireless or wired manner.

The detection sensor 24 may be disposed closer to the handle 20 than the cleaner body 10 in the suction hose 22.

For example, the length of the suction hose 22 may be divided into three parts to define three sections A to C.

The section A may be close to the cleaner body 10, the section C may be close to the handle 20, and the section B may be defined between the section A and the section C.

The detection sensor 24 may be disposed in the section C of the suction hose 22 so that a variation in inclination detected by the detection sensor 24 increases during a cleaning operation of the vacuum cleaner. As illustrated in FIG. 1, while a distance between the handle 20 and the cleaner body 10 is changed, a portion of the suction hose 22, which is adjacent to the handle 20, may be changed in inclination.

Thus, when the detection sensor 24 is installed in the section C of the suction hose 22, which is adjacent to the handle 20, the variation in inclination of the suction hose 22 detected by the detection sensor 24 may be large to accurately detect a position of the handle 20 of the cleaner body 10.

Particularly, when the length of the section C is divided equally, the detection sensor 24 may be installed at a portion of the section C, which is adjacent to the section B.

In case of a portion of the section C, which is directly connected to the handle 20, since the variation in inclination during the cleaning is relatively small, it is preferable that the detection sensor 24 is disposed at a portion of the section C, which is adjacent to the section B.

Hereinafter, an operation of the vacuum cleaner will be described.

FIG. 4 is a view illustrating a state in which the detection sensor is changed in position during the cleaning operation of the vacuum cleaner, and FIG. 5 is a flowchart for explaining a method of controlling the vacuum cleaner of FIG. 1.

Referring to FIGS. 4 and 5, the vacuum cleaner is turned on (S1) to drive the suction motor. Then, a user performs cleaning while moving the nozzle with respect to the floor by using the handle 20.

While the cleaning is performed, the distance between the cleaner body 10 and the handle 20 may vary as illustrated in FIGS. 1 and 4. As the handle 20 is away from the cleaner body 10, the suction hose 22 may be strained. Thus, the inclination of the suction hose 22, which is detected by the detection sensor 24, with respect to the floor may decrease.

The controller 30 determines whether the inclination of the suction hose 22 detected by the detection sensor 24 is less than a reference inclination (S2).

If the inclination of the suction hose 22 detected by the detection sensor 24 is less than the reference inclination as the result determined in the operation S2, it is determined that the handle 20 is away from the cleaner body 10 to control the wheel motors 12 (S3).

For example, the controller 30 may control the wheel motors 12 so that the cleaner body 10 moves forward.

Here, the controller 30 may control each of the wheel motors 12 so that the wheel motor 12 is stopped after operating for a predetermined time or after operating at the predetermined number of revolutions. Alternatively, when the inclination of the suction hose 22 detected by the detection sensor 24 is above a motor stopping inclination, the controller 30 may control the wheel motors 12 to be stopped.

According to this embodiment, since the detection sensor is relatively inexpensive when compared to an ultrasonic wave transmitting unit and an ultrasonic wave receiving unit, the cleaner body may follow the handle with an inexpensive cost.

Also, even if the user is positioned between the handle and the cleaner body, a detection error of the detection sensor may not occur, and thus, the cleaner body may accurately follow the handle.

FIG. 6 is a perspective view of a vacuum cleaner according to a second embodiment.

This embodiment is the same as the first embodiment except that an additional detection sensor is provided in an extension tube. Thus, only characterized parts in this embodiment will be described below.

Referring to FIGS. 1 and 6, in a vacuum cleaner according to this embodiment, a detection sensor 24 (or a first detection sensor) may be provided in the suction hose 22, and an additional detection sensor 25 (or a second detection sensor) may be provided in the extension tube 21.

The installed position of the detection sensor 24 is the same as that of the detection sensor 24 according to the first embodiment.

The additional detection sensor 25 may be used for detecting a state in which the handle 20 is placed on the floor during the cleaning.

When the cleaning is performed in a state of gripping the handle 20 as illustrated in FIG. 1, an angle between the extension tube 21 and the floor may be maintained within a predetermined angle range regardless of a distance between the handle 20 and the cleaner body 10.

In this state, as described above, the wheel motors 12 may be controlled according to the inclination of the suction hose 22 to allow the cleaner body 10 to move to follow the handle 20.

As illustrated in FIG. 6, the user may place the handle 20 on the floor during the cleaning. In this state, the inclination of the suction hose 22 may be less than the reference inclination. However, since the state in which the handle 20 is placed on the floor as illustrated in FIG. 6 is a state in which the user does not perform the cleaning, it is not necessary that the cleaner body 10 moves to the handle 20.

Thus, in this embodiment, although the suction hose 22 has an inclination less than the reference inclination, when an inclination of the extension tube 21 detected by the additional detection sensor 25 installed in the extension tube 21 is less than the reference inclination, the cleaner body 10 may be maintained in the stopped state without controlling the wheel motors 12.

According to this embodiment, the state in which the handle 20 is placed on the floor may be detected. In this state, the cleaner body 10 may be stopped to prevent the cleaner body 10 from unnecessarily moving.

FIG. 7 is a view of a vacuum cleaner according to a third embodiment, and FIGS. 8 and 9 are views illustrating an operation of the vacuum cleaner depending on an inclination of a suction hose of the vacuum cleaner of FIG. 7.

This embodiment is the same as the first embodiment except for the number of diction sensor. Thus, only characterized parts in this embodiment will be described below.

Referring to FIGS. 3, 7 to 9, a first diction sensor 41 and a second detection sensor 42 may be provided in the suction hose 22 according to this embodiment.

The first detection sensor 41 and the second detection sensor 42 may be disposed to be spaced apart from each other in a longitudinal direction of the suction hose 22.

Particularly, the length of the suction hose 22 may be divided into three parts to define three sections A to C.

The section A may be close to the cleaner body 10, the section C may be close to the handle 20, and the section B may be defined between the section A and the section C.

The first detection sensor 41 may be disposed in the section A, and the second detection sensor 42 may be disposed in the section C.

The position of the second detection sensor 42 in the section C may be the same as that of the detection sensor 24 described in the first embodiment.

When the length of the section A is equally divided into two portions, the first detection sensor 41 may be installed at a portion of the two portions, which is adjacent to the section B.

In case of a portion of the section A, which is directly connected to the cleaner body 10, since a variation in inclination during the cleaning is relatively small, it is preferable that the first detection sensor 41 is disposed at a portion of the section A, which is adjacent to the second B.

An inclination detected by each of the first detection sensor and the second detection sensor in a state in which the handle is away from the cleaner body as illustrated in FIG. 9 may be less than that detected by each of the first detection sensor and the second detection sensor in a state in which the handle is close to the cleaner body as illustrated in FIG. 8.

Thus, when the inclination detected by the first detection sensor 41 is less than a first reference inclination, and the inclination detected by the second detection sensor 42 is less than a second reference inclination, the controller 30 may control the wheel motors 12 to allow the cleaner body 10 to move to the handle 20.

When the plurality of detection sensors 41 and 42 are provided in the suction hose 22, the controller 30 may determine an inclination of the suction hose 22 by using a pitch value of each of the detection sensors 41 and 42 and determine whether the handle 20 is placed on the floor by using a roll value of each of the detection sensors 41 and 42.

For example, the handle 20 may move upright during the cleaning, and the handle 20 is laid down when placed on the floor.

In this case, since the suction hose 22 connected to the handle 20 is twisted, the roll value of at least one of the detection sensors 41 and 42 when the handle is placed on the floor may be greater than that of at least one of the detection sensors 41 and 42 when the handle 20 is disposed to be spaced a predetermined height from the floor. Thus, whether the handle 20 is placed on the floor may be determined by using the roll value.

Also, although the inclination detected by each of the plurality of detection sensors 41 and 42 is less than the reference inclination, if it is determined that the handle 20 is placed on the floor, the controller 30 may control the wheel motors 12 so that the cleaner body 10 does not move to the handle 20, but is maintained in the stopped state.

FIG. 10 is a view of a vacuum cleaner according to a fourth embodiment, and FIGS. 11 and 12 are views illustrating an operation of the vacuum cleaner depending on an inclination of the suction hose of the vacuum cleaner of FIG. 10.

This embodiment is the same as the third embodiment except for the number of diction sensor. Thus, only characterized parts in this embodiment will be described below.

Referring to FIGS. 10 to 12, a third detection sensor 43 may be additionally installed in the section B of the suction hose, unlike FIG. 7.

That is, in this embodiment, when the length of the suction hose 22 is divided into three parts, the detection sensors 41, 42, and 43 may be respectively disposed in the sections A, B, and C.

FIG. 13 is a view of a vacuum cleaner according to a fifth embodiment.

This embodiment is the same as the first embodiment except that a magnetic sensor is additionally provided in each of the suction hose and the cleaner body. Thus, a characterized part according to the current embodiment will be principally described.

Referring to FIG. 13, a detection sensor 50 for detecting an inclination of the suction hose 22 may be provided in the suction hose 22 according to this embodiment.

Since the position of the detection sensor 50 in the suction hose 22 is the same that of the detection sensor 24 according to the first embodiment, its detailed description will be omitted.

A pair of wheels 11*a* and 11*b* are provided in the cleaner body 10. The pair of wheels 11*a* and 11*b* may be rotated by a pair of wheel motors 12*a* and 12*b* that are independently driven.

A first magnetic sensor 51 may be provided in the cleaner body 10, and a second magnetic sensor 52 and a third magnetic sensor 53 may be provided in the suction hose 22. Here, the third magnetic sensor 53 may be omitted.

Although not limited, the second magnetic sensor 52 may be disposed at a central portion of the suction hose 22, and the third magnetic sensor 53 may be disposed at a position adjacent to the handle 20.

On the other hand, the second magnetic sensor 52 may be disposed at any position of the suction hose 22, and the third magnetic sensor 52 may be disposed in the handle 20, the extension tube 21, or the nozzle.

The first magnetic sensor 51 may serve as a reference sensor.

The controller may determine a moving direction of the handle 20 on the basis of a first difference value between an angle detected by the first magnetic sensor 51 and an angle detected by the second magnetic sensor 52 and/or a second difference value between an angle detected by the first magnetic sensor 51 and an angle detected by the third magnetic sensor 53 by using an angle detected by the first magnetic sensor as a reference angle.

When the handle 20 moves in a left direction as illustrated in FIG. 13, each of the first difference value and the second difference value may be greater than a reference difference value.

Thus, when the handle 20 moves in the left direction as illustrated in FIG. 13, the controller may control the wheel motors so that the left wheel motor 12*a* has a rotation rate greater than that of the right wheel motor 12*b* to allow the cleaner body 10 to rotate in the left direction.

Thus, according to this embodiment, the cleaner body 10 may move forward toward the handle 20 and also rotate, and thus, the cleaner body 10 may accurately follow the handle 20.

FIGS. 14 and 15 are views of a vacuum cleaner according to a sixth embodiment.

This embodiment is the same as the first embodiment except that a distance sensor is additionally provided. Thus, a characterized part according to the current embodiment will be principally described.

Referring to FIGS. 14 and 15, a detection sensor 71 for detecting an inclination of the suction hose 22 may be provided in the suction hose 22 according to this embodiment.

Since the position of the detection sensor 71 in the suction hose 22 is the same that of the detection sensor 24 according to the first embodiment, its detailed description will be omitted.

The vacuum cleaner according to this embodiment may further include distance sensors 72 and 73 for detecting a distance between the handle 20 and the cleaner body 10.

The distance sensors 72 and 73 may include a first sensor 72 provided in the cleaner body 10 and a second sensor 73 provided in the handle 20.

The distance sensors 72 and 73 may be an ultrasonic sensor using ultrasonic waves or an RF sensor. Alternatively, each of the distance sensors 72 and 73 may be an ultra wide band (UWB) sensor.

In this embodiment, when an inclination of the suction hose 22 detected by the detection sensor 71 is less than a reference inclination, and a distance between the cleaner body 10 and the handle 20 is greater than a reference distance, the controller may control the wheel motor 12 so that the cleaner body 10 moves to the handle 20.

The user may perform cleaning on an area having a high height such as a ceiling by using the handle 20. Here, as illustrated in FIG. 14, the distance between the cleaner body 10 and the handle 20 may be greater than the reference distance, and the inclination of the suction hose 22 may be greater than the reference inclination.

In the state as illustrated in FIG. 14, it is preferable that the cleaner body 10 does not move. Thus, in this embodiment, as illustrated in FIG. 14, when the inclination of the suction hose 22 is greater than the reference inclination although the distance between the cleaner body 10 and the handle 20 is greater than the reference distance, the cleaner body 10 may be maintained in a stopped state.

On the other hand, when the handle 20 is away from the cleaner body 10 during the cleaning as illustrated in FIG. 15, the distance between the cleaner body 10 and the handle 20 is greater than the reference distance, and the inclination of the suction hose 22 is less than the reference inclination as illustrated in FIG. 14. Thus, the cleaner body 10 may move to the handle 20.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

The invention claimed is:

1. A vacuum cleaner comprising:

a cleaner body comprising a wheel for moving and a wheel motor for driving the wheel;

a suction hose connected to the cleaner body;

a handle connected to the suction hose;

a first detection sensor disposed at the suction hose to detect an inclination of the suction hose; and a controller configured to control the wheel motor on a basis of the inclination of the suction hose detected by the first detection sensor, wherein the first detection sensor is closer to the handle than the cleaner body at the suction hose.

2. The vacuum cleaner of claim 1, wherein the first detection sensor comprises an acceleration sensor, a 6-axis sensor, or a 9-axis sensor.

3. The vacuum cleaner of claim 1, wherein a length of the suction hose is divided into three parts to define sections A to C, and when the section A is close to the cleaner body, the section C is close to the handle, and the section B is defined between the section A and the section C, the first detection sensor is installed on the section C.

4. The vacuum cleaner of claim 3, wherein, when the section C is divided equally, the first detection sensor is disposed at a portion of the section C, which is adjacent to the section B.

5. The vacuum cleaner of claim 1, wherein, when the inclination of the suction hose detected by the first detection sensor is less than a reference inclination, the controller controls the wheel motor to allow the cleaner body to move to the handle.

6. The vacuum cleaner of claim 5, further comprising an extension tube coupled to the handle, wherein an additional detection sensor for detecting an inclination of the extension tube is provided at the extension tube.

7. The vacuum cleaner of claim 6, wherein, when the inclination of the extension tube detected by the additional detection sensor is less than an extension tube reference inclination even though the inclination of the suction hose detected by the first detection sensor is less than the reference inclination, the controller controls the wheel motor so that the cleaner body is maintained in a stopped state.

8. The vacuum cleaner of claim 1, further comprising a second detection sensor disposed to be spaced apart from the first detection sensor in a longitudinal direction of the suction hose.

9. The vacuum cleaner of claim 8, wherein a length of the suction hose is divided into three parts to define sections A to C, and when the section A is close to the cleaner body, the section C is close to the handle, and the section B is defined between the section A and the section C, the second detection sensor is disposed at the section A, and the first detection sensor is disposed at the section C.

10. The vacuum cleaner of claim 9, further comprising a third detection sensor disposed at the section B.

11. The vacuum cleaner of claim 9, wherein the second detection sensor is disposed closer to the section B than the cleaner body at the section A, and the first detection sensor is disposed closer to the section B than the handle at the section C.

12. The vacuum cleaner of claim 1, further comprising:

a first magnetic sensor provided at the cleaner body; and at least one second magnetic sensor provided on at least one of the suction hose and the handle, wherein the controller determines a moving direction of the handle and controls the wheel motor so that the cleaner body moves in the moving direction of the handle, on a basis of a difference value between an angle detected by the first magnetic sensor and an angle detected by the at least one second magnetic sensor.

13. The vacuum cleaner of claim 1, further comprising a distance sensor for detecting a distance between the cleaner body and the handle, wherein, when the inclination of the suction hose detected by the first detection sensor is less than a reference inclination, and a distance between the cleaner body and the handle is greater than a reference distance, the controller controls the wheel motor so that the cleaner body moves to the handle.

* * * * *